United States Patent [19]

Tolfsen

[11] 3,973,343

[45] Aug. 10, 1976

[54] PICTURE FRAME HAVING A PICTURE MOUNT

[76] Inventor: Miriam O. Tolfsen, 34-19 90th St., Jackson Heights, N.Y. 11372

[22] Filed: Apr. 21, 1975

[21] Appl. No.: 570,116

Related U.S. Application Data

[63] Continuation of Ser. No. 290,474, Sept. 20, 1972, abandoned.

[52] U.S. Cl. ..... 40/152.1

[51] Int. Cl.[2] ..... G09F 1/12

[58] Field of Search ..... 40/125 F, 124, 156, 40/152.1; 248/463, 466

[56] References Cited

UNITED STATES PATENTS

| | | | |
|---|---|---|---|
| 412,953 | 10/1889 | Gale | 40/152.1 |
| 1,778,636 | 10/1930 | Herbert | 40/152.1 |
| 1,809,786 | 6/1931 | Le Jeune | 40/156 X |
| 2,195,985 | 4/1940 | Fox | 40/125 F X |
| 3,360,227 | 12/1967 | Overton | 248/463 X |
| 3,611,604 | 10/1971 | Saltzman | 40/158 R |

*Primary Examiner*—Louis G. Mancene
*Assistant Examiner*—Wenceslao J. Contreras
*Attorney, Agent, or Firm*—Arthur A. March

[57] ABSTRACT

A picture frame includes an outer glass or plastic enclosure and an inner mounting base or board made of a fibrous or porous material such as fiberboard, cork and the like, to facilitate the mounting of picture elements either by pressure or by pin fasteners thereon. In one embodiment, the frame includes an outer rectangular glass or transparent plastic panel, an intermediate panel of cork or fiberboard or other material and an end panel of a backing board or of glass or plastic which are held in assembly by screw bolts, which are secured at their ends by bolt heads which also engage on the picture frame supporting bracket. Various holders are associated with the fiberboard or mounting board which provide ornamental pin elements which may be used for holding the pictures in an oriented position. The frame may however be used without these as the pressure of the screw or bolt will hold pictures in place under the glass or transparent plastic.

The frame may also comprise a frame member of a material such as wood which defines an outer encircling recess in the frame for the transparent view-through element, such as glass, and a central uniformly dimensioned portion in which the material on which pictures are placed is positioned and which is attached to a backing board. The end of the frame includes a wide encircling channel or receiving recess for an additional backing element. A wire supporting element or stand is fastened to the backboard. The backboard may, for example, be of a material capable of being engaged with a securing element such as a fastening screw or bolt for the stand.

4 Claims, 13 Drawing Figures

FIG. 13
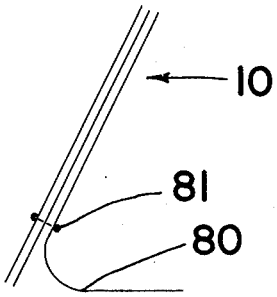
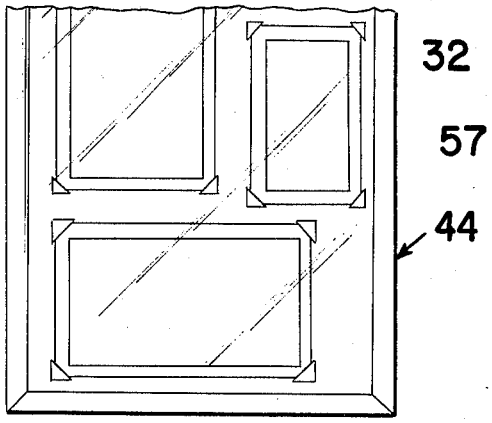
FIG. 8
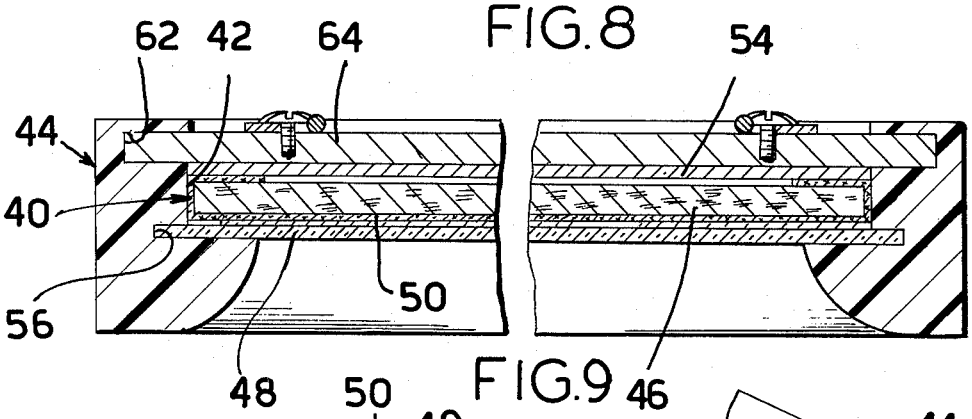
FIG. 9
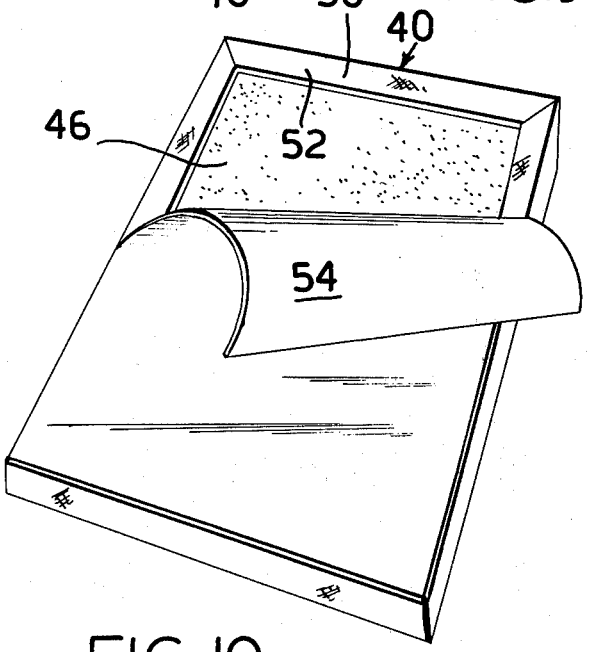
FIG. 10
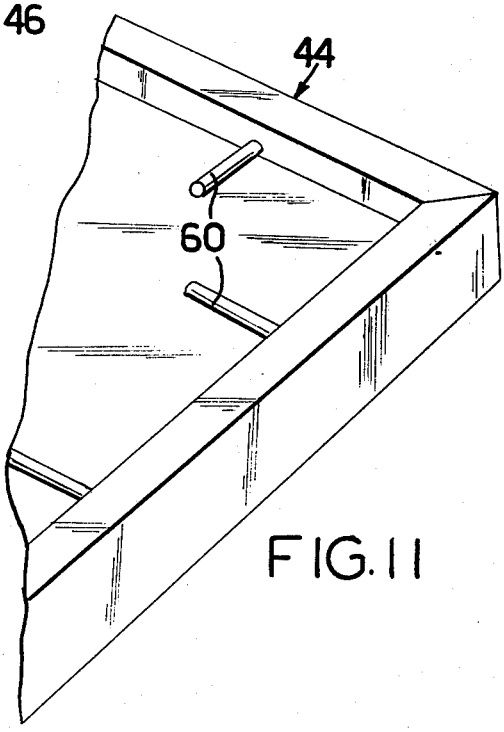
FIG. 11

PICTURE FRAME HAVING A PICTURE MOUNT

This is a continuation of copending application Ser. No. 290,474 filed Sept. 20, 1972 and now abandoned.

BACKGROUND OF THE INVENTION

1. FIELD OF THE INVENTION

This invention relates in general to the construction of picture frames and, in particular, to a new and useful frame construction which includes an element forming a mounting base for pictures which are to be exhibited, and with a backing or plastic board which may be secured to a wire supporting bracket.

2. DESCRIPTION OF THE PRIOR ART

At the present time, it is known to construct a picture frame with a widened receiving channel for a backing material and with a plurality of encircling receiving channels in the frame, into which various elements such as a viewing glass and the picture elements themselves may be inserted. The present invention is an improvement over devices of that type, particularly in respect to the use of a backing board made of a fibrous material which is covered with a fabric which provides an ornamental mounting base for pictures or other display elements. The known devices are constructed to receive only a mounting mat for a photograph or the like which is adapted to be secured to the photograph, such as by adhesive. A disadvantage in such an arrangement is that the picture can usually only be held in position peripherally and a plurality of individual picture elements cannot be positioned on the viewing area. Also in existing frames pictures cannot be easily changed or rearranged whereas in the frame described herein they can.

SUMMARY OF THE INVENTION

In accordance with the present invention, there is provided a picture frame which includes a backing board made of a material, such as cork or fiberboard, which may be covered with a fabric so that the exterior thereof presents an aesthetic appearance, providing a mounting for one or more picture elements. The fiberboard or similar material is adapted to be employed if desired with one or more ornamental holders which may be secured over the picture or display to be exhibited, to hold it on the backing board. The frame is constructed so that the pictures may be held in a position in the frame to the rear of a glass or transparent plastic viewing panel. The dimension of the backing material may be regulated in accordance with the thickness of a backing board which is placed in an encircling recess located in the frame at a spaced location rearwardly from an encircling groove holding the glass panel.

In accordance with another arrangement of the invention, the backing board or plastic is held in an assembly with the mounting board and a glass or transparent plastic panel in a manner such that the holding bracket of a wire configuration is also simultaneously secured in the assembly. In addition, the outer securing element forms an ornamental bolt head in the face of the glass or transparent plastic panel to enhance the features of the device.

Accordingly, it is an object of the invention to provide an improved picture frame construction which includes a mounting panel made of a material which permits the mounting of one or a plurality of picture elements in any select position on the backing board.

Pictures may be held in place by pressure or framed by one or more ornamental holders, having pin engagement means which engage into the mounting element.

A further object of the invention is to provide a picture assembly which includes a plurality of panels, one of which includes a glass outer panel and a backing board arranged behind the glass outer panel made of a fibrous or other resilient type material, in combination with a supporting element of wire which is held in the assembly at the location of screw bolt members which engage each leg thereof.

A further object of the invention is to provide a picture frame assembly which includes a wooden frame element having an outer encircling recess or groove defined in the interior of the frame for receiving a glass panel, an intermediate area for receiving a picture or other display mounting board and a rear encircling groove for receiving a backing board, the backing board being secured to a wire holder.

A further object of the invention is to provide a picture frame assembly which may be easily dismantled by the user so that he may remove the pictures without effort and insert new ones making a new and different display.

A further object is to provide an attractive method of showing photos or pictures in which pictures are dust-free and protected.

A further object of the invention is to provide a picture frame assembly which is simple in design, rugged in construction and economical to manufacture.

A further object of the invention is to provide panels held together by bolts or "spacer" or "post" screws which can easily be opened to separate panels and again easily closed.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWING

In the drawing:

FIG. 8 is a front elevational view of the picture frame as shown in FIG. 6;

FIG. 9 is a section taken along the line 9—9 of FIG. 6;

FIG. 10 is a top perspective view of the construction of the mounting board with a portion of the backing board removed;

FIG. 11 is a partial rear perspective view showing one manner in which the backing board is held in position within the frame;

FIG. 13 is an end elevational view of the frame showing another type of support arrangement.

GENERAL DESCRIPTION OF THE PREFERRED EMBODIMENTS

Figure 1:
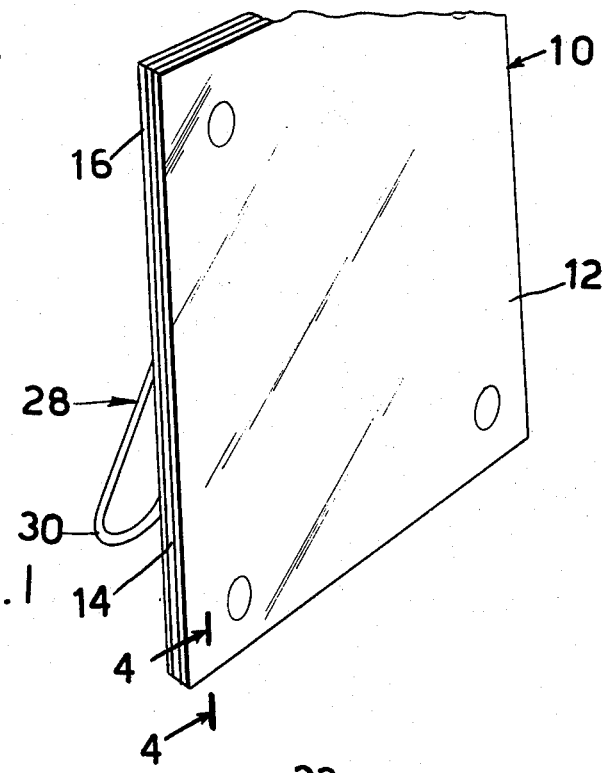
FIG. 1 is a front end perspective view of a picture frame constructed in accordance with the invention.
Figure 2:
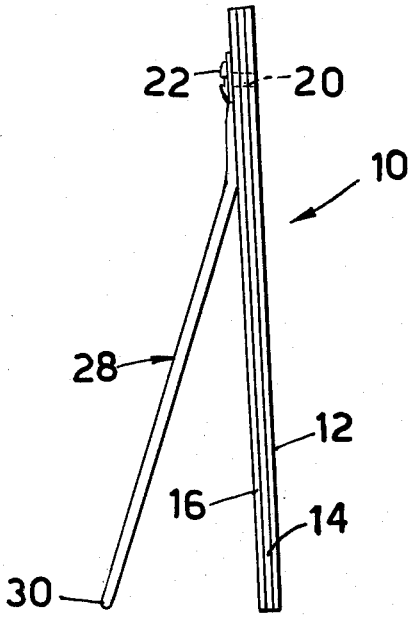
FIG. 2 is an end elevational view of the frame shown in FIG. 1.
Figure 3:
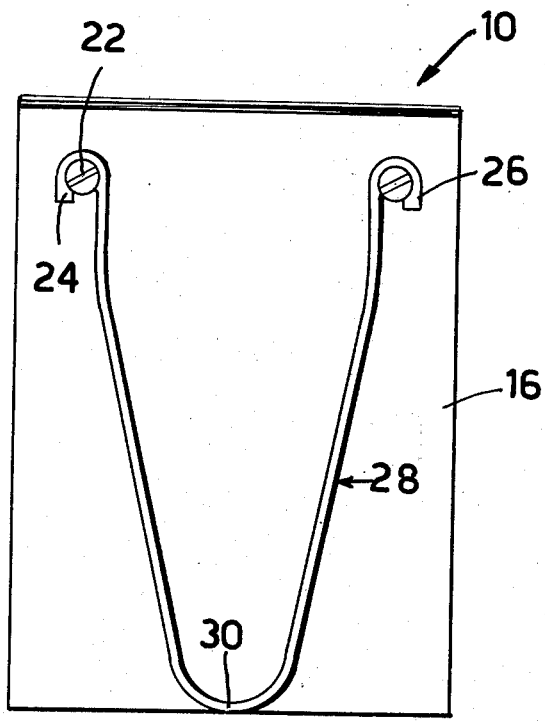
FIG. 3 is a rear elevational view of the frame shown in FIG. 1.
Figure 4:
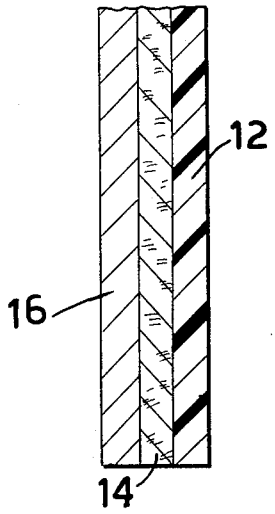
FIG. 4 is a section taken along the line 4—4 of FIG. 1.
Figure 5:
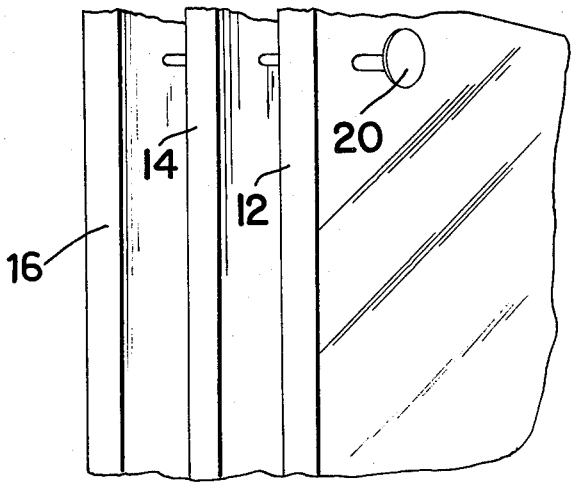
FIG. 5 is an enlarged separated view of the panels used in the embodiment shown in FIG. 1.

Referring to the drawing in particular, the invention embodied therein as shown in FIGS. 1 to 5, comprises a frame assembly, generally designated 10, which includes an outer transparent panel 12, made of a material such as glass, plexiglass, lucite, etc., an intermediate mounting board panel 14, and an outer or rear backing panel 16. A feature of this construction is that the assembly is held together by several securing bolts 20, which extend through the panels after they are arranged together, and includes a head portion 22, which engages around the U-shaped ends 24 and 26 of a stand or holding bracket, generally designated 28. The holding bracket 28 includes a central portion 30 forming a base which is supported on a table or other display location to support the whole frame assembly 10.

Figure 12:
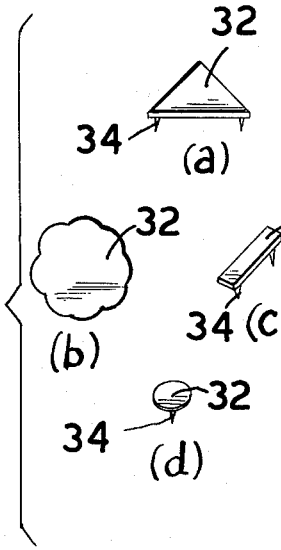
FIG. 12 are perspective view of various designs of securing elements for the mounting board.

The inventive arrangement includes a mounting board 14 made of a material which is capable of receiving and retaining pin holders 32, and some of the possible designs of the pin holders are shown in FIGS. 12*a*, 12*b*, 12*c* and 12*d*. The holders 32 may be of a decorative design, such as, in the form of a baseball bat, or croquet wicket, a ship, a car, etc. Each holder 32 includes one or more projecting pin elements or pins 34 which engage into the material of the mounting board 14. They may be applied at locations in which they form corners, for example, as shown in FIG. 8. This is not the only type of application, however, they may be inserted directly through the material to be exhibited, or at any location to penetrate the material and hold it to the mounting board 14.

In another variation of the invention the pin holders may be eliminated and pressure screws may be utilized to hold the assembly together with the pictures in a frictional engagement with each other.

Figure 6:
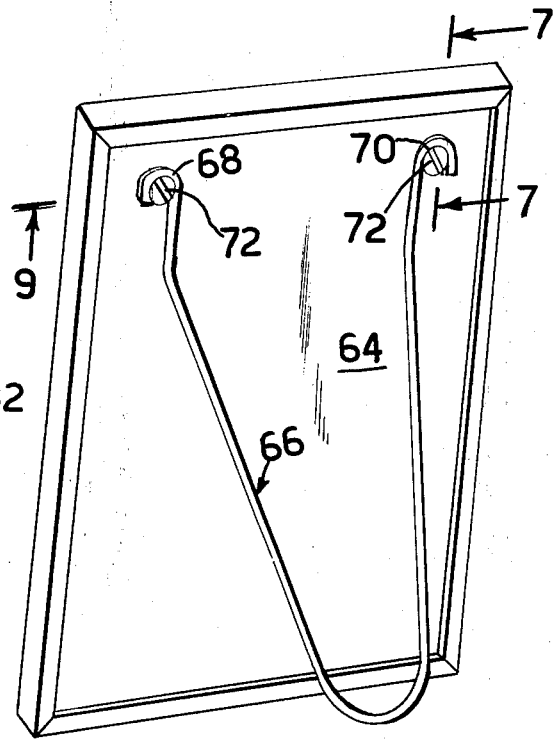
FIG. 6 is a rear perspective view of another embodiment of the picture frame assembly.
Figure 7:
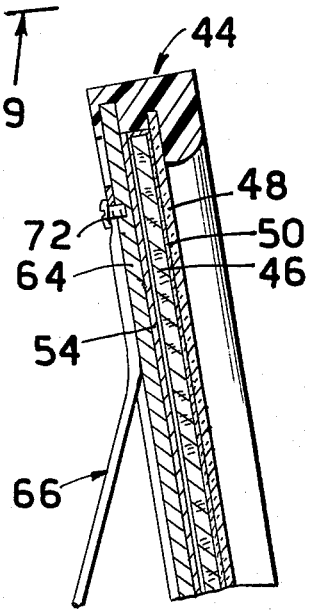
FIG. 7 is a section taken along the line 7—7 of FIG. 6.

As shown in FIGS. 9 and 10 in particular, for the embodiment of FIGS. 6 through 11, the preferred form of a mounting board comprises a mounting board, generally designated 40, which is located within an intermediate area 42, of a frame, generally designated 44. In this construction, the mounting board 40 includes a mounting board or panel of a fibrous material 46 which may, for example be cork, foam plastic, fiber or the like. The mounting board is advantageously covered, on the side facing a glass panel or see-through panel 48, with a fabric 50, which is wrapped around the board 46 and forms a marginal strip 52 at the interior end or back end. The fabric is provided to enhance the appearance or to provide a decorative effect if desired. A backing board 54 is applied over this marginal strip 52, such as by adhesive. The front of the mounting board 40 provides means for securing pictures or other display items in position as desired using the holders 32.

A further feature of the construction of the embodiment of FIGS. 8 to 12 is the outer frame 44 which includes a first encircling recess or groove 56 which accommodates the glass panel 48 and which may be slid into position in the groove 56 from one end of the frame after the transverse frame member 57 (FIG. 8) is first removed. The intermediate area 42 accommodates the mounting board 40 plus the backing board 54. A tight fit of this backing board against the glass outer element 48 may be effected by using wedge member or securing elements 60 which engage into the frame 44.

The rear of the frame 44 includes an encircling recess or groove 62 which accommodates a backboard or holder board 64 which is made of a semi-rigid material, such as wood, cardboard, plastic and the like. A support, generally designated 66, includes shaped ends 68 and 70 which are engaged around bolts or screw elements 72 which are engaged in the backing board 64. The support 64 is similar to the one shown in the other embodiment.

As shown in FIG. 13, the frame 10 hereinbefore described is utilized. In this modification the rear stand 80 may be secured to lower screws 81 and extends as shown to retain the frame in its appropriate displaying position. This rear stand may comprise a plastic sheet bent upon itself to form the base.

While specific embodiments of the invention have been shown and described in detail to illustrate the application of the principles of the invention, it will be understood that the invention may be embodied otherwise without departing from such principles.

What is claimed is:

1. An exhibiting device for displaying pictures, displays, etc., which comprises a frame assembly of a plurality of panels including an outer transparent panel, an intermediate mounting board panel and a rear backing board panel, said mounting board panel being of a resilient porous material, fastening means in the form of a corresponding screw bolt extending through said panels adjacent the tops thereof on each side thereof and holding said panels together to provide said frame assembly, and a U-shaped holder having a corresponding leg with a rounded end engaged around and being simultaneously held by the screw bolt at each side under corresponding screw bolt pressure thereat and an intermediate portion extending down for positioning on a support to hold the frame assembly in an erect position.

2. Device according to claim 1, including pin means engageable with said intermediate mounting board for holding display items on said intermediate mounting board.

3. Device according to claim 1 wherein said panels form the exterior surface of said frame assembly.

4. An exhibiting device according to claim 1 for displaying pictures, displays, and the like, which comprises a frame assembly of a plurality of panels including an outer transparent panel, an intermediate mounting board panel and a rear backing panel, said mounting board panel being of a resilient porous material, a U-shaped holder adjacent said rear backing panel and having a pair of legs each upwardly terminating in a corresponding screw bolt engagement rounded end and an intermediate portion joining said legs and extending downwardly for positioning on a support to hold the frame assembly in an erect position, and a pair of laterally spaced screw bolts extending through said panels adjacent the tops thereof at the corresponding lateral sides of said panels and operatively engaging the corresponding rounded ends of said U-shaped holder and holding said panels and said U-shaped holder together under the corresponding screw bolt pressure thereat to provide said frame assembly with said panels forming the exterior surface of said frame assembly.

* * * * *